United States Patent [19]

Brännström

[11] 3,939,921

[45] Feb. 24, 1976

[54] METHOD AND DEVICE FOR DAMPING THE MOVEMENT OF A HAMMER PISTON

[75] Inventor: Kurt Östen Brännström, Saltsjo-Boo, Sweden

[73] Assignee: Atlas Copco Aktiebolag, Nacka, Sweden

[22] Filed: Dec. 16, 1974

[21] Appl. No.: 533,135

[30] Foreign Application Priority Data

Dec. 31, 1973 Sweden ..... 7317608

[52] U.S. Cl. ..... 173/121; 173/139

[51] Int. Cl.[2] ..... E21B 9/10

[58] Field of Search ..... 173/118–121, 173/139

[56] References Cited

UNITED STATES PATENTS

| | | | |
|---|---|---|---|
| 2,926,637 | 3/1960 | Sparlin | 173/121 |
| 3,570,608 | 3/1971 | Erma | 173/139 |
| 3,720,269 | 12/1970 | Wanner et al. | 173/139 |

*Primary Examiner*—James A. Leppink
*Attorney, Agent, or Firm*—Flynn & Frishauf

[57] ABSTRACT

A method for damping the movement of the hammer piston of a hammer mechanism and for catching the hammer piston in a forward end position when the drill tool is situated outside the operating range of the hammer piston is disclosed. During the return stroke of the hammer piston gas is driven from one chamber to another chamber through a slot. When the hammer piston exceeds its normal range of operation gas is driven through the slot in the other direction and also through a channel in the machine housing so that a weaker damping is obtained than during the return stroke. A hammer mechanism to be operated according to the above method is also disclosed.

8 Claims, 3 Drawing Figures

METHOD AND DEVICE FOR DAMPING THE MOVEMENT OF A HAMMER PISTON

The present invention relates to a method and a hammer mechanism for damping the movement of a hammer piston included in the hammer mechanism and for catching the hammer piston when a tool associated with the hammer mechanism is situated outside the operating range of the hammer piston.

By means of the present invention which has the characteristics given in the subsequent claims, the problem of preventing the hammer piston from hitting the machine housing during the return stroke and being damaged and making possible the catching of the hammer piston at its front end position is effectively solved. When the hammer piston is situated in its front end position a forceful flushing of a drill-hole is made possible as shown in the below described embodiment of the invention.

In a prior solution of the above mentioned problem a hammer ring being concentric with the hammer piston is used for stopping the hammer piston during its return stroke and a slot between the hammer piston and the hammer ring is used for catching the hammer piston when the tool is situated outside the operating range of the hammer piston.

Through the present invention it has been made possible to exclude the above mentioned hammer ring.

DETAILED DESCRIPTION

Figure 1:
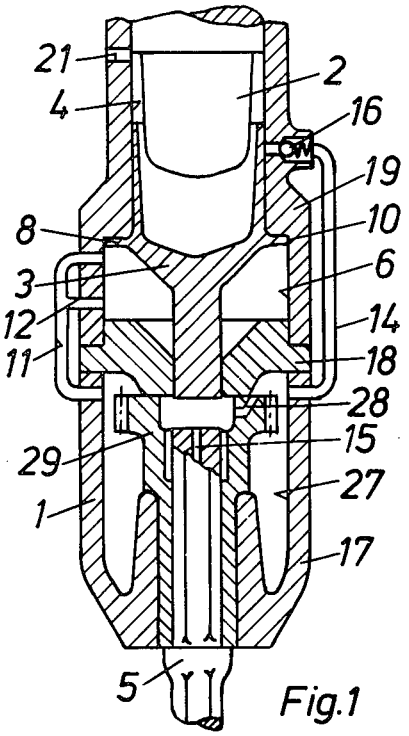
FIG. 1 shows a part section through a hammer mechanism with the hammer piston in its rearward end position.
Figure 2:
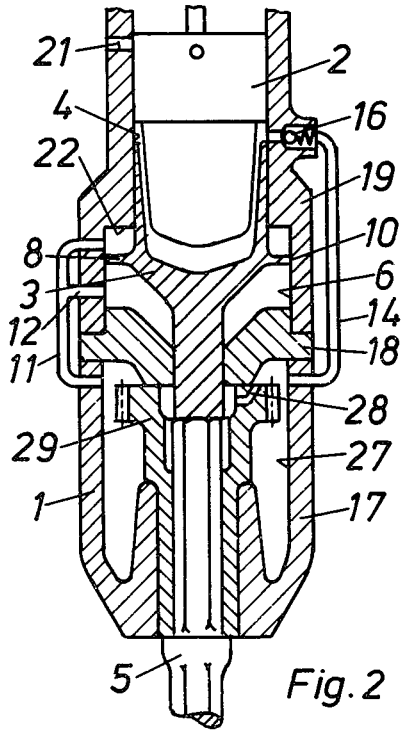
FIG. 2 shows a part section of the hammer mechanism with the hammer piston in the impact position.

The hammer mechanism shown comprises a machine housing 1 which comprises a lower part 17, a middle part 18 and an upper part 19. A driving piston 2 is reciprocably movable in the machine housing 1 and driven by an internal combustion engine 26 (FIG. 3) via a crankshaft 20. The hammer mechanism is included in a rock drilling machine 24 which is provided with handles 25 for easy operation by the operator. The driving piston 2 is meant for driving a hammer piston 3 towards a tool 5 via a pressure-gas cushion in a working chamber 4. This pressure-gas cushion is achieved in that the driving piston 2 compresses air which is let in through the air inlet 21 when the driving piston takes the position shown in FIG. 1. The hammer piston 3 is provided with a flange 8. Between the flange 8 and the machine housing 1 there is a slot 10 through which air is driven for damping the movement of the hammer piston 3. Depending on the direction of movement of the hammer piston the air is driven either from a first chamber 22 situated behind the flange 8 of the hammer piston 3 or from a second chamber 6 situated in front of the hammer piston. When the hammer piston 3 is in the position shown in FIG. 2 air is driven from the working chamber 4 via the check valve 16 and the conduit 14 to the chamber 27. From the chamber 27 air is driven via a channel 28 in a drill-sleeve 29 to a channel 15 in the drill-tool 5 for flushing the drill hole. During the drilling the pressure in the chamber 27 is about 0.15 atmosphere gauge, i.e. substantially atmosperic pressure. A channel 11 connects the chamber 27 to either the first chamber 22 or the second chamber 6 depending on the position of the hammer piston 3. A channel 12 connects the second chamber 6 to the channel 11 so that it together with the slot 10 forms the restriction which gives a weaker damping of the hammer piston 3 when it exceeds its normal working stroke to take the position shown in FIG. 3 than during the return stroke when the slot 10 alone achieves the damping. The chambers 6 and 22 can be connected to the surrounding atmosphere instead of to the chamber 27. Since the hammer piston 3 passes the channel 12 shortly before it comes to the position shown in FIG. 3 the hammer piston is prevented from becoming hurt during extreme operating conditions. Since air is expelled from the working chamber 4 through the conduit 14 during the working stroke, the return of the hammer piston 3 is secured because of the subatmospheric pressure created in the working chamber 4 during the return of the driving piston 2.

Figure 3:
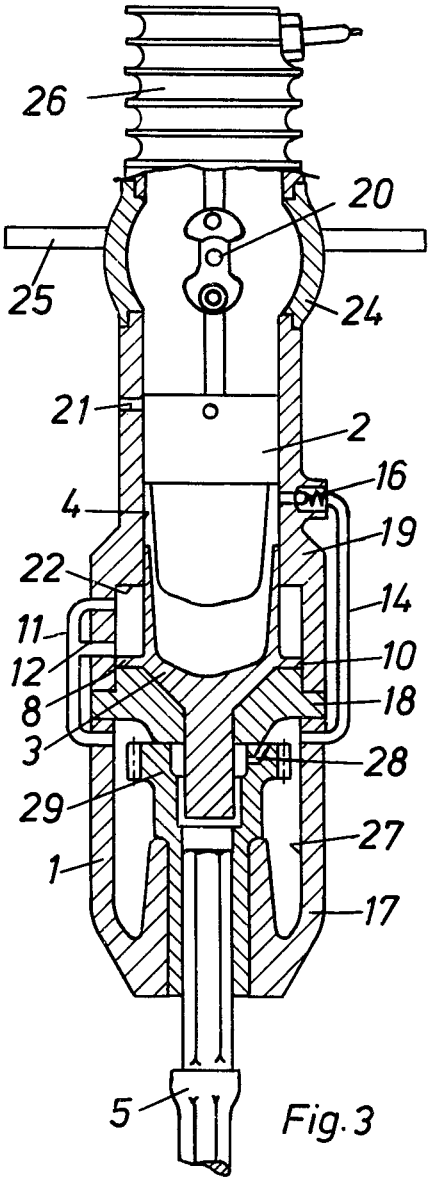
FIG. 3 shows the hammer mechanism partly in section with the hammer piston in its front end position.

The hammer mechanism shown works in the following way. When the driving piston 2 is in the position shown in FIG. 1 the working chamber 4 is filled with air through the air inlet 21. When the driving piston 2 moves forwards the air inlet 21 is closed after which the air in the working chamber 4 is compressed. Through this a pressure-gas cushion is created which drives the hammer piston 3 towards the tool 5. In the position shown in FIG. 2 the hammer piston 3 impacts the tool and uncovers the connection, via the conduit 14, between the working chamber 4 and the chamber 27. Through this flushing air is achieved for flushing the drill-hole. Furthermore, the first chamber 22 is filled with air via the channel 11. After having impacted the tool 5 the hammer piston 3 recoils and is braked at its rearward end position by a first pneumatic means which comprises the first chamber 22 and the slot 10. When forceful flushing of the drill-hole is wanted the operator lifts the drilling machine 24 by means of the handle 25 so that the drill-tool 5 is displaced to a position outside the operating range of the hammer piston 3 as shown in FIG. 3. Through this the hammer piston 3 is driven past the position shown in FIG. 2 and is damped by a second pneumatic means which comprises the second chamber 6, the slot 10, and the channel 12. Since air now also is driven through the channel 12 a weaker damping of the movement of the hammer piston 3 is achieved than during the return stroke. Through this damping arrangement the hammer piston 3 can be stopped in the position shown in FIG. 3 so that the driving piston 2 only pumps air through the conduit 14 and the channel 15 for flushing the drill-hole.

The above described and illustrated embodiment of the invention is only to be regarded as an example which can be modified within the scope of the subsequent claims.

What I claim is:

1. A method for damping the movement of a hammer piston (3) incorporated in a hammer mechanism, the hammer mechanism including a driving piston (2) reciprocably movable in a machine housing (1), the method comprising:

driving said hammer piston (3) towards a tool (5) by said driving piston (2) via a pressure-gas cushion formed in a working chamber (4) of said housing (1) between said driving piston (2) and said hammer piston (3), and pneumatically damping the movement of said hammer piston (3) during the main part of the return stroke of the hammer piston (3), and pneumatically damping the movement of the hammer piston (3) when it exceeds its normal working stroke and catching the hammer piston (3) essentially without recoil at its forward end position when the tool is situated outside the operating range of the hammer piston, the pneumatic damping during the return stroke being greater than that applied when the hammer piston (3) exceeds its normal working stroke.

2. A method according to claim 1, wherein the step of pneumatically damping the hammer piston (3) during its return stroke comprises driving the gas during the return stroke of the hammer piston (3) from a first chamber (22) in the machine housing (1) through a restricted slot (10) between the hammer piston and the machine housing to a second chamber (6) in the machine housing, whereby hammer piston (3) is braked at its rearward end position.

3. A method according to claim 2, wherein the step of pneumatically damping the hammer piston (3) when it exceeds its normal stroke comprises driving the gas from said second chamber (6) through said slot (10) to said first chamber (22) and also through a channel (12) in the machine housing (1) to substantially atmospheric pressure when the hammer piston (3) exceeds its normal working stroke, whereby the hammer piston is braked and caught at its forward end position.

4. A hammer mechanism comprising:

a machine housing (1) having a working chamber (4) therein, a driving piston (2) reciprocably movable in the machine housing, a hammer piston (3) arranged to be driven towards a tool (5) by the driving piston (2) via a pressure-gas cushion formed in the working chamber (4), a first pneumatic means (22,10) for damping the movement of the hammer piston (3) during its return stroke, and a second pneumatic means (6,10,12) for damping the movement of the hammer piston (3) when it exceeds its normal working stroke and for catching the hammer piston (3) substantially without recoil at its forward end position, said first pneumatic means damping the movement of the hammer piston (3) more than said second pneumatic means.

5. A hammer mechanism according to claim 4, wherein said first pneumatic means comprises a first chamber (22) and a slot (10) formed between the hammer piston (3) and the machine housing (1), said first chamber (22) being situated behind said slot (10) relative to the forward end of said housing.

6. A hammer mechanism according to claim 5, wherein said pneumatic means comprises a second chamber (6), a channel (12) in the machine housing (1) connected to said second chamber (6), and said slot (10), said second chamber (6) being situated in front of said slot (10).

7. A hammer mechanism according to claim 5 wherein said first pneumatic means comprises a channel (11) coupling said first chamber (22) with a flushing chamber (27) of said hammer mechanism, said hammer piston including means (8) for blocking said channel (11) during a portion of the return stroke of the hammer piston (3).

8. A hammer mechanism according to claim 6 wherein said hammer piston (3) includes means (8) for blocking said channel (12) from said second chamber (6) when said hammer piston (3) is moved toward its position wherein it exceeds its normal working stroke.

* * * * *